United States Patent [19]

Hess et al.

[11] 4,101,245

[45] Jul. 18, 1978

[54] INTERBLADE DAMPER AND SEAL FOR TURBOMACHINERY ROTOR

[75] Inventors: John R. Hess, Westchester, Ohio; Herbert Frederick Asplund, South Windsor, Conn.

[73] Assignee: United Technologies Corporation, Hartford, Conn.

[21] Appl. No.: 754,666

[22] Filed: Dec. 27, 1976

[51] Int. Cl.[2] ..... F01D 5/26

[52] U.S. Cl. ..... 416/190; 416/193 A; 416/221; 416/500

[58] Field of Search ..... 416/219, 221, 190, 193 A, 416/500, 191

[56] References Cited

U.S. PATENT DOCUMENTS

| | | | |
|---|---|---|---|
| 3,112,915 | 12/1963 | Morris | 416/193 A X |
| 3,610,778 | 10/1971 | Suter | 416/193 A X |
| 3,666,376 | 5/1972 | Damlis | 416/220 X |
| 3,709,631 | 1/1973 | Karstensen et al. | 416/220 X |
| 3,723,023 | 3/1973 | Crick | 416/219 |
| 3,751,183 | 8/1973 | Nichols et al. | 416/220 |
| 3,887,298 | 6/1975 | Hess et al. | 416/220 |
| 3,936,222 | 2/1976 | Asplund et al. | 416/193 A X |
| 4,029,436 | 6/1977 | Shoup et al. | 416/221 |

FOREIGN PATENT DOCUMENTS

| | | | |
|---|---|---|---|
| 1,259,750 | 1/1972 | United Kingdom | 416/221 |

*Primary Examiner*—Everette A. Powell, Jr.
*Attorney, Agent, or Firm*—Vernon F. Hauschild

[57] ABSTRACT

An interblade seal and vibration damper to be positioned in the damper cavity defined between a rotor disc, adjacent blades and adjacent blade platforms so as to seal across an interplatform gap by providing line contact between the damper and the platforms on opposite sides thereof for the full axial dimension of the cavity and with the damper shaped so as to have a low center of gravity for operational stability and which damper also responds to centrifugal force during rotor operation to establish damping friction between said damper and said platforms when the platforms move circumferentially.

13 Claims, 4 Drawing Figures

INTERBLADE DAMPER AND SEAL FOR TURBOMACHINERY ROTOR

BACKGROUND OF THE INVENTION

1. Field of the Invention

This invention relates to an interblade seal and vibration damper for a turbomachinery rotor in which sealing between adjacent blades or their platform is accomplished by producing line contact between the damper and adjacent blade platforms for the full axial dimension of the blade or platforms so that there is minimal hot gas leakage therearound into the blade damper cavity and which damper is fabricated and supported so as to be stable in operation.

2. Description of the Prior Art

While there are many turbomachinery rotor interblade vibration dampers and seals in the prior art, there are not believed to be any which perform these functions while providing line contact between the damper and the blade or its platform for the full axial dimension thereof and with controlled axial clearance between the damper and its retention mechanism so as to maximally prevent hot gas leakage into the rotor interior and simultaneously provide blade vibration damping, while possessing a low center of gravity for stable operation. Our U.S. Pat. Nos. 3,936,222 and 3,666,376 are typical of the prior art construction and it will be noted therein that while providing damping, no surface exists between ribs 30 and 32 against which damper can seal. In addition, the damper shown rests on inclined, not straight surfaces and does not possess the feature of having a low center of gravity. Our U.S. Pat. No. 3,936,222 is also typical of the prior art construction.

SUMMARY OF THE INVENTION

A primary object of the present invention is to provide an interblade seal and vibration damper for a turbomachinery rotor which performs an optimum sealing function, an optimum blade damper function, and which is highly stable in operation.

In accordance with the present invention, such a damper is formed and operates to provide line contact with the adjacent blades for the full axial dimension thereof and with minimal controlled damper-to-axial retainer clearance occurring at the opposite axial ends of the damper.

In accordance with a further aspect of the present invention, the blade or its platform includes an appropriate recess which receives a portion of the damper so that the damper, when centrifugally loaded in operation, has a low center of gravity with respect to the blade sealing surfaces and therefore maximum stability in operation.

A further feature of our damper invention is that it is fabricated to provide a uniform axial damping force on the turbomachinery blades, that the damper has a low center of gravity, and uniform axial weight distribution for positive centrifugal seating and stability, and that the damper be fabricated for foolproof assembly.

It is a further feature of our invention that the damper bear against parallel flat surfaces on adjacent blades so as to extend across the inter-blade circumferential gap, which surfaces lie in a plane parallel to the rotor axis and perpendicular to the radial line passing midway between these flat surfaces.

It is a further feature of our invention that our damper include tab members at opposite axial ends thereof which are in selected radial spaced relationship to the turbomachinery disc so as to prevent tumbling of the damper in operation.

It is a further feature of our invention that it may be used with industrial turbomachinery since only minimal hot gas circulation is permitted across the damper and seal combination into the damper cavity between adjacent blades and the disc, thereby permitting the disc to be made of a less expensive material than would be the case if it had to be capable of operating at higher temperatures inherent with classic designs of this type.

It is a further object to provide such a combined damper-seal which can be installed and removed from either side of the rotor and with the blades in place.

DESCRIPTION OF THE PREFERRED EMBODIMENT

Figure 1:
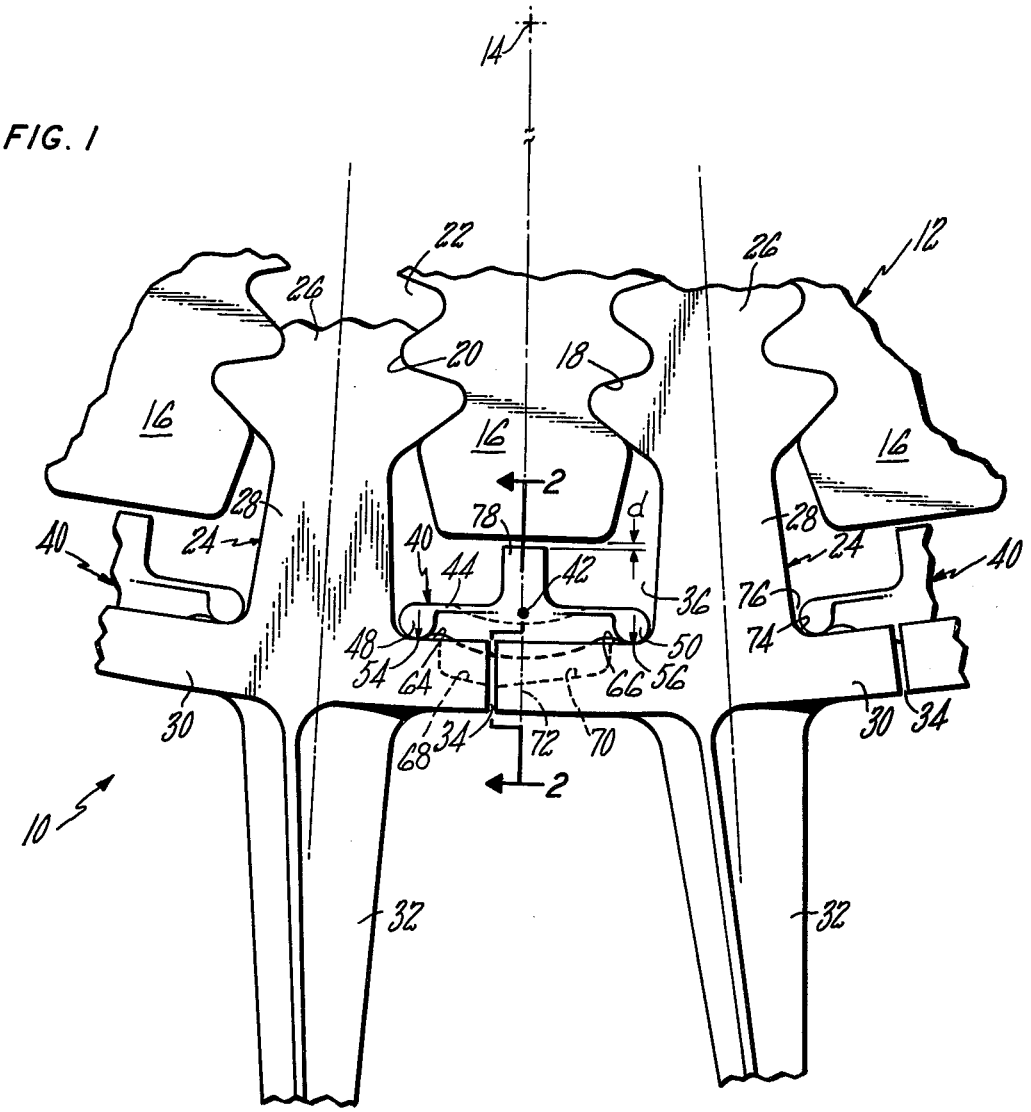
FIG. 1 is a showing taken through a portion of a turbomachinery rotor with sideplates removed, to illustrate the construction of our interblade seal and vibration damper and its position in the blade damper cavity.

Referring to FIG. 1 we see turbomachinery rotor 10, which could either be a turbine or compressor rotor, and which includes central disc 12 supported in conventional fashion for rotation about axis of rotation 14. Disc 12 includes a plurality of disc lugs 16 projecting radially from the disc and spaced circumferentially thereabout and including fir-tree shaped exterior surfaces 18 and 20 which cooperate with such surfaces on adjacent disc lugs to define fir-tree shaped female cavities 22 therebetween. A plurality of blades 24 are positioned circumferentially about disc 12 and each projects substantially radially therefrom and includes root portion 26, which is of fir-tree shaped cross-section so as to be snugly received and contained in a disc fir-tree female cavity 22, shank portion 28, a blade platform 30 on opposite circumferential sides thereof, and a blade airfoil section 32, which is preferably shroudless. While a fir-tree connection is illustrated as supporting blades 24 from disc 12, it will be evident to those skilled in the art that other conventional blade retention mechanisms could be utilized without departing from the spirit of this invention. Blade platforms 30 extend circumferentially on opposite sides of blades 24 and adjacent platforms define circumferential gap 34 therebetween. By viewing FIG. 1, it will be noted that disc 12, adjacent blade shank portions 28, and adjacent blade platforms 30 cooperate to define blade damper cavity 36 therebetween. Sideplates, which will be described hereinafter, form the axially forward and rearward boundary of cavity 36. It will therefore be seen that as hot gases pass over rotor 10, they could pass through gap 34 and into cavity 36 in recirculation fashion thereby causing the blade and disc portions bordering cavity 36 to operate at a considerably higher temperature than they would encounter if the hot gas recirculation thereinto could be prevented or minimized. It is an important object of this invention to prevent the recirculation of hot gas into cavity 36 by the use of blade damper 40.

Figure 3:
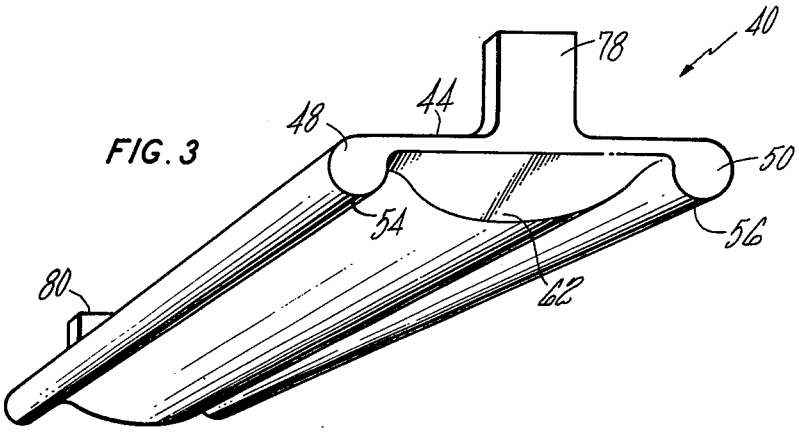
FIGS. 3 and 4 are perspective showings of our seal and vibration damper.
Figure 4:
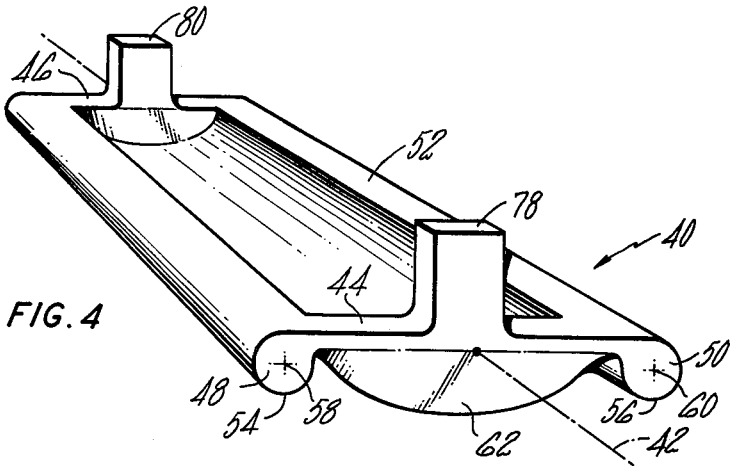

As best shown in FIGS. 3 and 4, damper 40 is of one piece construction and preferably made from a uniform material such as a high temperature nickel-base alloy and is solid in construction. Damper 40 is preferably cast INCO 718 (AMS 5383). Damper 40 is preferably of symmetric construction on opposite sides of its axis 42, which may parallel to axis of rotation 14 in operation. Damper 40 is generally rectangular in shape and includes laterally extending and parallel support members 44 and 46 at its opposite axial ends, which join and cooperate with laterally spaced parallel rails 48 and 50 to define box shaped strength frame 52 about the periphery of damper 40. Rails 48 and 50 include contact surfaces 54 and 56 which are preferably of circular shape about axes 58 and 60, and which may be finish machined for perfect sealing contact as described hereinafter. Between end frames 44 and 46, damper 40 is dished between rails 48 and 50 to define concave central portions 62.

As best shown in FIG. 1, damper 40 extends axially in cavity 36 parallel to axis of rotation 14 and with rails 48 and 50 contacting flat, and preferably machined surfaces 64 and 66 of adjacent blade platforms 30, thereby extending across gap 34 and establishing parallel, line damper-to-platform sealing contact on opposite sides thereof for the full axial dimension of cavity 36. Platforms 30 are fabricated so as to include recessed portions 68 and 70, each of which extend axially for substantially the full axial dimension of blades 24 and open into cavity 36 and gap 34 so as to cooperate and define therebetween continuous, axially extending recess 73 extending for substantially the full axial dimension of blades 24 at platforms 30 and receiving the concave damper portion 62, or at least a portion thereof, thereinto so that the damper center of gravity, as illustrated is substantially in alignment with surfaces 64 and 66, thereby providing a damper 40 which has a very low center of gravity in rotor operation so that the damper has maximum stability in operation. Damper rails 48 and 50 and platform flat surfaces 64 and 66 are preferably finish machined, at least in the region of line contact therebetween. The line contact between rail 48 and surface 64 is parallel to the line contact between rail 50 and surface 66.

While damper 40 is shown and described as rectangular in shape, it could well be a parallelogram if gap 34 and cavity 36 were biased with respect to axis 14, and thus the damper axis and the damper cavity axis and fir tree recess axis would preferably be parallel.

It is important to the teaching of this invention that surfaces 64 and 66 be parallel to one another and lie in a plane parallel to the rotor axis 14 and perpendicular to a radial line 72 passing midway between surfaces 64 and 66. In view of this orientation of surfaces 64 and 66, centrifugal sealing and damping forces created by rotor rotation do not cause the damper-seal to have a tendency to be displaced fore or aft or laterally with respect to these surfaces. In addition, relative motion between adjacent blades will not impart any radial forces to the damper, which radial forces could cause a bouncing action in the damper. The damper-seal therefore provides uniform and constant sealing and damping forces parallel to radial line 72 independent of the magnitude of relative blade-to-blade motion. In this fashion, damper 40 is loaded perpendicular to the plane of surfaces 64 and 66 as illustrated by arrows so that there is no force component acting upon damper 40 during operation to cause it to shift laterally, that is circumferentially, in cavity 36. The central positioning and stability of damper 40 is further enhanced by the cooperating curvature 74, between platform 30 and shank 28 of blade 24, which serves to establish a very small circumferential spacing 76 between damper 40 and blade 24. It should further be noted that the blade platforms are of maximum thickness and hence strength at contact lines 54 and 56 where damper loads are imparted thereto.

Figure 2:
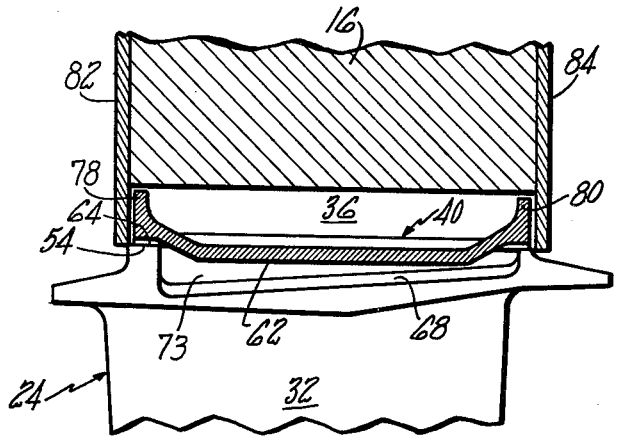
FIG. 2 is a cross sectional showing through section 2—2 of FIG. 1.

Tabs 78 and 80 project out of axially forward and rearward frame members 44 and 46 and perpendicular thereto and are preferably flush with the outboard surfaces thereof so that, as best shown in FIG. 1, the tabs, which extend radially inwardly when rotor 10 is rotating, are spaced a selected distance "*d*" from disc lug 16 and serve to prevent damper 40 from tumbling in cavity 36, especially when the damper 40 is not under the influence of centrifugal force. As best shown in FIG. 2, lugs 78 and 80 cooperate with the forward and rearward outboard surfaces of damper 40 to establish a controlled and very minor clearance, preferably about 0.003 inches, between damper 40 and sideplates 82 and 84, which are connected to disc 12 and extend outwardly as shown to axially restrain blades 24 and damper 40 therebetween. Rotor 10 may generally be of the type shown in U.S. Pat. No. 3,936,222.

It will accordingly be seen that any engine hot air which enters gap 34 into the area under damper 40 will be blocked by the line contact which exists between damper rails 48 and 56 and flat surfaces 64 and 66 for the full axial dimension of blade 24 and cavity 36 from passing therebetween, and may pass into cavity 36 only through the very minor axial clearance existing between the damper and the sideplates, but such clearance is so small that minimal recirculation of hot air into chamber 36 will be permitted therethrough.

In addition to performing the above described sealing function, this line contact between rails 48 and 50 and surfaces 64 and 66, respectively, acts under centrifugal loading during rotor operation, to establish friction damping of blades 24 as blades 24 attempts to move laterally, i.e. circumferentially, with respect to damper 40. In view of the fact that damper 40 is symmetric about its axially extending axis 42, and is also of uniform construction on opposite sides thereof, the axial weight distribution along damper 40 is therefore uniform so that uniform friction and sealing loading therefore occurs throughout the full axial dimension of damper 40 between the rails 48 and 50 and damping and sealing surfaces 64 and 66.

It will further be noted by viewing FIG. 1 that blade damper cavity is of substantially consistent lateral or circumferential cross sectional shape throughout its axial dimension, as is damper 40, so that, with side plates 82 and/or 84 removed, damper 40 may be inserted into cavity 36 without regard to forward or aft end of damper and from either axial end of rotor 10 and with blades 24 in place and will operate in precisely the same fashion. This is an assembly foolproofing feature.

We wish it to be understood that we do not desire to be limited to the exact details of construction shown and described, for obvious modifications will occur to a person skilled in the art.

We claim:

1. A turbomachinery rotor comprising:

(A) a central disc adapted to be rotated about an axis of rotation extending axially of the rotor, (B) a plurality of blades connected to the periphery of said disc to form a circumferential array of blades about the periphery of the disc and with each blade having, (1) a platform extending generally circumferentially from opposite sides of each blade so that platforms of adjacent blades terminate in close circumferential proximity to define a circumferential gap of selected size between adjacent blade platforms and so that the disc and adjacent blades and their platforms cooperate to define a blade damper cavity therebetween communicating with said gap, and (a) each platform including a flat surface adjacent the blade and generally facing the disc axis and extending for substantially the full axial dimension of the cavity to define a part of said cavity and positioned so that the blade platform flat surfaces of adjacent blades in each cavity are parallel and lie in the same plane, which plane is perpendicular to a radial line extending from said axis of rotation and passing midway between said flat surfaces in each cavity and (b) a recessed portion extending for substantially the full axial dimension of the blade damper cavity and opening thereinto and into the platform circumferential gap so that said recessed portions of adjacent platforms cooperate to define a continuous recess extending substantially for the full axial dimension of the damper cavity and opening thereinto, (C) a one-piece blade damper and seal located in said blade damper cavity and extending for substantially the full axial dimension thereof and overlapping said flat surfaces of adjacent blade platforms and having, (1) rails of curved cross-section extending in parallel relationship for the full axial dimension of the damper on opposite lateral sides thereof so that said rails contact adjacent platform single plane, flat surfaces in line contact for substantially the full axial dimension of the cavity, (2) a solid central portion of the blade damper extending between said rails and across said gap and outwardly into the blade platform recess so that the blade damper center of gravity is located on or near said platform flat surfaces so that, in response to centrifugal force, the blade damper rails bear in line contact against adjacent blade platform single plane, flat surfaces for substantially the full axial dimension of the blade damper cavity to cooperate with the central portion to seal said cavity from said gap to thereby prevent recirculation of hot gases through said gap and around said damper into said blade damper cavity, and so that as each blade platform moves circumferentially during rotor operation, the line contact between the damper rail and the platform flat surface will establish friction therebetween to dampen blade motion.

2. A rotor according to claim 1 wherein said blade damper and seal has a centerline and wherein said damper is symmetrically shaped on opposite lateral sides thereof and of uniform construction on opposite sides thereof so that the damper is of uniform axial weight distribution and thereby provides a uniform axial damping and sealing force to the blades.

3. A rotor according to claim 2 wherein said blade platforms are shaped to be thicker at said flat surface than at said recessed portion so that the platform carries blade damper loads at said thicker flat section.

4. A rotor according to claim 3 wherein said blade damper and seal cavity and said platform continuous recess are axially extending and of substantially consistent lateral cross sectional shape and so that said blade damper is axially extending and of symmetric lateral cross section along its axis so that said blade damper and seal may be assembled into said blade damper cavity and platform continuous recess from either axial side of said rotor either with blades in place or during assembly of blades.

5. A rotor according to claim 4 wherein each blade includes a radially extending neck or shank portion radially inboard of the blade platform and which blades are shaped and sized so that with adjacent blades assembled onto the central disc, the circumferential spacing between adjacent blade neck portions is slightly larger than the damper lateral dimension.

6. A rotor according to claim 5 and including means to retain said blades axially with respect to said disc and means to retain said damper and seal axially within said damper cavity.

7. A rotor according to claim 6 wherein said retaining means constitute side plates attached to opposite sides of said disc and extending radially outwardly therefrom to be positioned at opposite axial ends of said blades and said damper and seal for axial retention thereof and for partially defining said damper cavity.

8. A rotor according to claim 7 and including means to connect said blades to said disc including a plurality of radially extending and circumferentially spaced lug members projecting from the periphery of the disc and being shaped in circumferential cross section to form an axially extending male fir-tree connecting member and so that adjacent lugs define an axially extending female fir-tree connection recess, and wherein each blade has a fir-tree shaped root portion shaped to be snugly received in the female fir-tree connection recess between adjacent disc lugs, and wherein each disc lug has a circumferentially extending outer radial surface of selected radial spacing from said platform flat surfaces with said blades so retained from said disc.

9. A rotor according to claim 8 wherein said damper and seal has radially inwardly extending tabs at the opposite axial ends thereof and sized to be spaced a selected radial distance from said lug outer surface when said damper is positioned in said damper cavity so that said tabs will come into contact with said lug outer surface if the damper attempts to pivot on either of the damper rails.

10. A rotor according to claim 9 wherein said damper and seal is shaped to have a laterally extending frame extending between said rails at the opposite axial ends thereof so that said frame members and said rails form a box shaped strength frame about the periphery of said damper and seal to provide structural rigidity thereto.

11. A rotor according to claim 10 wherein said blades are shroudless.

12. A rotor according to claim 9 wherein the axial clearance between said damper and seal and said side plates is about 0.003 inches.

13. A rotor according to claim 1 wherein said rail members and said platform flat surfaces are finish machined and wherein said blade damper and seal is shaped so that the two lines of contact formed between the blade damper rails and the platform flat surfaces within a given blade damper cavity are parallel to one another and to said disc axis.

* * * * *